US009905946B2

(12) United States Patent
Tsai et al.

(10) Patent No.: US 9,905,946 B2
(45) Date of Patent: Feb. 27, 2018

(54) RECEPTACLE ELECTRICAL CONNECTOR FOR IMPROVING MANUFACTURING PROCESS EFFICIENCY

(71) Applicant: Advanced-Connectek Inc., New Taipei (TW)

(72) Inventors: Yu Lun Tsai, New Taipei (TW); Pin Yuan Hou, New Taipei (TW); Chung Fu Liao, New Taipei (TW); Chuan I Lin, New Taipei (TW); Dong Xiang, New Taipei (TW); Da Wei Zhu, New Taipei (TW); Long Fei Chen, New Taipei (TW); Rui Su, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 0 days.

(21) Appl. No.: 15/292,549

(22) Filed: Oct. 13, 2016

(65) Prior Publication Data

US 2017/0110812 A1 Apr. 20, 2017

(30) Foreign Application Priority Data

Oct. 20, 2015 (CN) ..... 2015 1 0677719

(51) Int. Cl.

| | |
|---|---|
| ***H01R 12/57*** | (2011.01) |
| ***H01R 13/516*** | (2006.01) |
| ***H01R 13/6585*** | (2011.01) |
| ***H01R 24/60*** | (2011.01) |
| *H01R 107/00* | (2006.01) |

(52) U.S. Cl.

CPC ..... *H01R 12/57* (2013.01); *H01R 13/516* (2013.01); *H01R 13/6585* (2013.01); *H01R 24/60* (2013.01); *H01R 2107/00* (2013.01)

(58) Field of Classification Search

CPC .. H01R 12/57; H01R 13/516; H01R 13/6585; H01R 24/60; H01R 2107/00; H01R 13/6461; H01R 13/665; H01R 13/658; H01R 13/6592; H01R 13/6587; H01R 13/6593; H01R 13/504

USPC ..... 439/607.05, 607.41, 607.46, 607.51, 439/607.55, 607.57, 660

See application file for complete search history.

(56) References Cited

U.S. PATENT DOCUMENTS 5,100,338 A * 3/1992 Lu ..... H01R 12/57 439/326
9,214,766 B1 * 12/2015 Yu ..... H01R 13/6585
(Continued)

*Primary Examiner* — Tho D Ta
*Assistant Examiner* — Travis Chambers
(74) *Attorney, Agent, or Firm* — C. G. Mersereau; Nikolai & Mersereau, P.A.

(57) ABSTRACT

A receptacle electrical connector has an insulated housing, a first terminal set, a second terminal set, a shielding plate and a metallic shell. The shielding plate has two connection portions formed respectively on two opposite sides of the shielding plate and each connection portion has a cutting surface. The cutting surface is formed on the connection portion, and the two cutting surfaces of the connection portions are exposed out of two opposite sides of the insulated housing. During the insert-molding processes of insulated housings, the connection beltings of metallic beltings are connected to the cutting surfaces of multiple shielding plates for simultaneously forming multiple insulated housings. Therefore, production efficiency and yield rate of the receptacle electrical connectors are enhanced.

13 Claims, 12 Drawing Sheets

(56) References Cited

U.S. PATENT DOCUMENTS

| | | | | |
|---|---|---|---|---|
| 9,478,915 | B2 * | 10/2016 | Guo | H01R 13/6585 |
| 9,496,653 | B2 * | 11/2016 | Little | H01R 13/6582 |
| 9,525,243 | B1 * | 12/2016 | Yuan | H01R 13/6585 |
| 2009/0029600 | A1 * | 1/2009 | Xiong | H01R 13/65802<br>439/676 |
| 2011/0310517 | A1 * | 12/2011 | Neumetzler | H01T 4/06<br>361/56 |
| 2013/0337692 | A1 * | 12/2013 | Yu | H01R 4/023<br>439/626 |
| 2014/0194005 | A1 * | 7/2014 | Little | H01R 13/6585<br>439/607.28 |
| 2015/0349447 | A1 * | 12/2015 | Chang | H01R 13/405<br>439/218 |
| 2016/0020572 | A1 * | 1/2016 | Ju | H01R 24/78<br>264/272.14 |
| 2016/0104976 | A1 * | 4/2016 | Yu | H01R 13/6585<br>439/607.05 |
| 2016/0126677 | A1 * | 5/2016 | Yu | H01R 13/6474<br>439/607.23 |

* cited by examiner

RECEPTACLE ELECTRICAL CONNECTOR FOR IMPROVING MANUFACTURING PROCESS EFFICIENCY

BACKGROUND OF THE INVENTION

1. Field of the Invention

The instant disclosure relates to an electrical connector, and more particularly to a receptacle electrical connector that improves manufacturing process efficiency. During a batch manufacturing process of the receptacle electrical connector, metallic beltings are employed to connect multiple shielding plates, and multiple sets of terminals and multiple insulative housing are formed and assembled respectively onto the shielding plates simultaneously by an insert-molding process, which enhances the productivity of the receptacle electrical connector.

2. Description of Related Art

Electrical connectors are general electrical components on electronic devices widely used for connecting to other matching connectors on the other electrical devices. For example universal serial bus (USB) 3.1 connectors are conventional and products that are available and equipped in a variety of electronic devices.

USB 3.1 protocol has been further developed to include USB Type C connector that is able to provide ultrahigh data transmission speed of 10 Gbps and has a light and compact structure especially suitable for portable devices. The USB Type C connector is also featured with a reversible socket for reversible connection for extensive applications on different electrical devices.

A USB type C receptacle connector has an insulative housing, a metal plate, two terminal sets and a metallic shell. The insulative housing is made of plastic and has a tongue portion formed on and protrudes from the insulative housing. The metal plate is embedded in the insulative housing by an insert-molding process. The terminal sets are mounted on the insulative housing and are able to transmit signals. The metallic shell covers the insulative housing and the terminal sets.

However, each insert-molding process only forms one insulative housing onto one metal plate. To implement batch production of multiple insulative housings, multiple sequential insert-molding processes are required to attach each insulative housing to each metal plate, which is low efficient and disadvantages mass production of the receptacle connectors.

To overcome the shortcomings, the instant disclosure provides a receptacle electrical connector for improving manufacturing process efficiency to mitigate or obviate the aforementioned problems.

SUMMARY OF THE INVENTION

The main objective of the invention is to provide a receptacle electrical connector that improves manufacturing process efficiency. During a batch manufacturing process of the receptacle electrical connector, metallic beltings are employed to connect multiple shielding plates, and multiple sets of terminals and multiple insulative housing are formed and assembled respectively onto the shielding plates simultaneously by an insert-molding process, which enhances the productivity of the receptacle electrical connector.

A receptacle electrical connector in accordance with the instant disclosure comprises an insulated housing, a first terminal set, a second terminal set, a shielding plate and a metallic shell. The shielding plate has two connection portions formed respectively on two opposite sides of the shielding plate and each connection portion has a cutting surface. The cutting surface is formed on the connection portion, and the two cutting surfaces of the connection portions are exposed out of two opposite sides of the insulated housing. During the insert-molding processes of insulated housings, the connection beltings of metallic beltings are connected to multiple shielding plates for simultaneously forming multiple insulated housings. Therefore, production efficiency and yield rate of the receptacle electrical connectors are enhanced.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
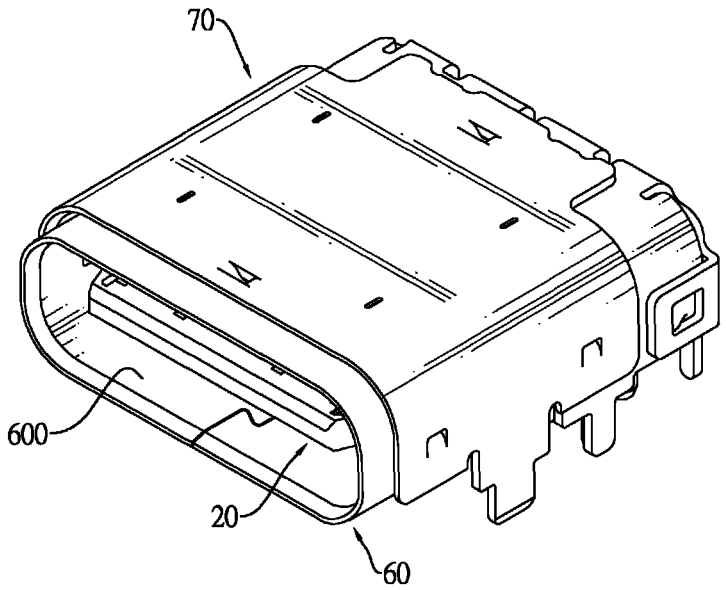
FIG. 1 is a perspective view of a first embodiment of a receptacle electrical connector for improving manufacturing process efficiency in accordance with the instant disclosure.
Figure 6:
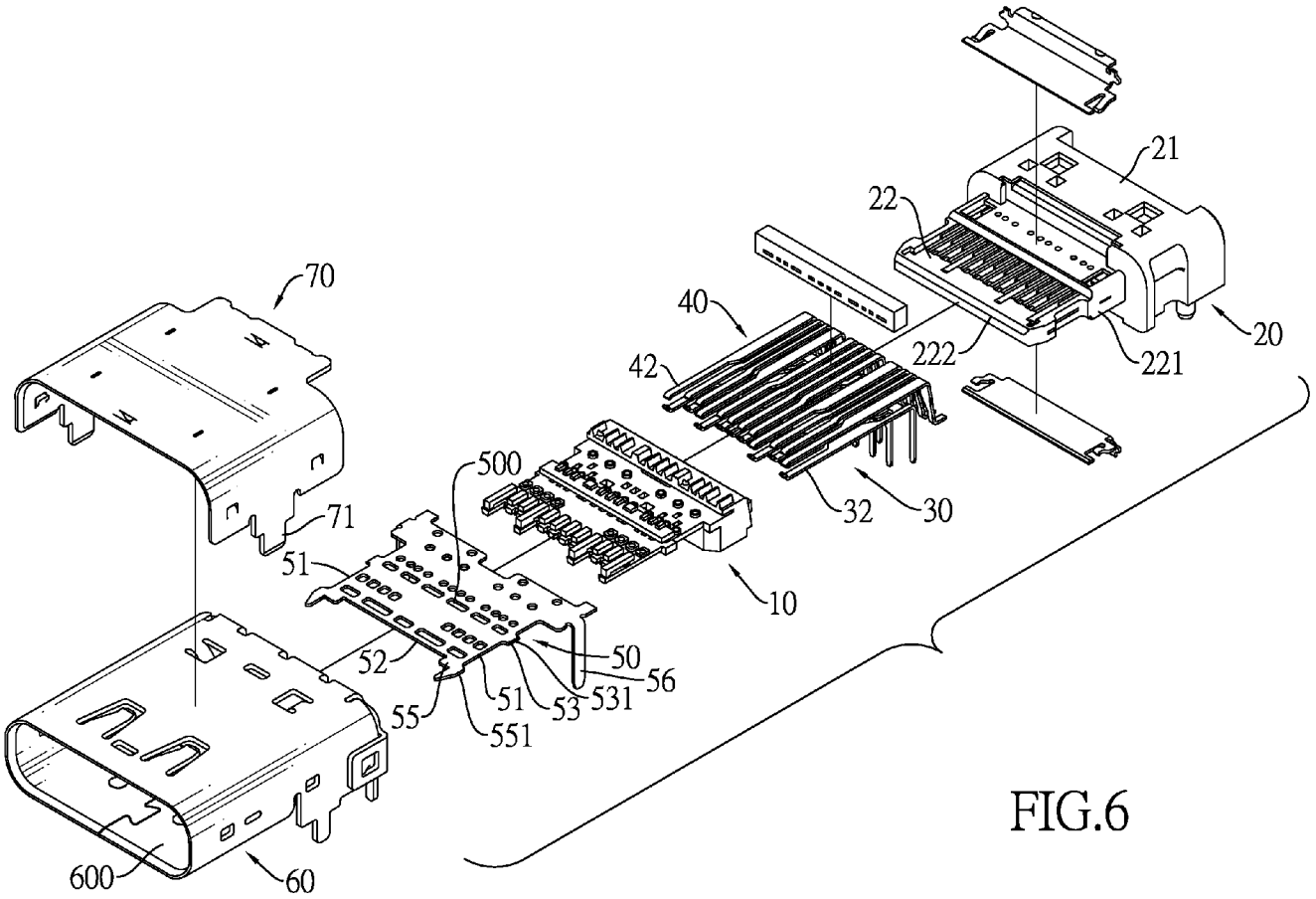
FIG. 6 is an exploded perspective view of the receptacle electrical connector in FIG. 1.

With reference to FIGS. 1 and 6, a first embodiment of a receptacle electrical connector for improving manufacturing process efficiency in accordance with the instant disclosure comprises an insulated housing, a first terminal set, a second terminal set, a shielding plate 50, a metallic shell 60 and an outer metallic shell 70.

The insulated housing has a first insulated housing 10 and a second insulated housing 20.

The second insulated housing 20 is mounted on the first insulated housing 10 to form the insulated housing. The second insulated housing 20 has a base portion 21 and a tongue portion 22. The tongue portion 22 is formed on and protrudes forward from the base portion 21.

The first terminal set is held in the insulated housing, may be mounted on the first insulated housing 10, and has multiple first terminals 30. The first terminals 30 are held in the insulated housing, may be mounted on the first insulated housing 10, and each first terminal 30 has a first electrical contact section 32. The first electrical contact section 32 is formed on a front end of the first terminal 30 and is disposed on a bottom surface of the tongue portion 22.

Figure 7:
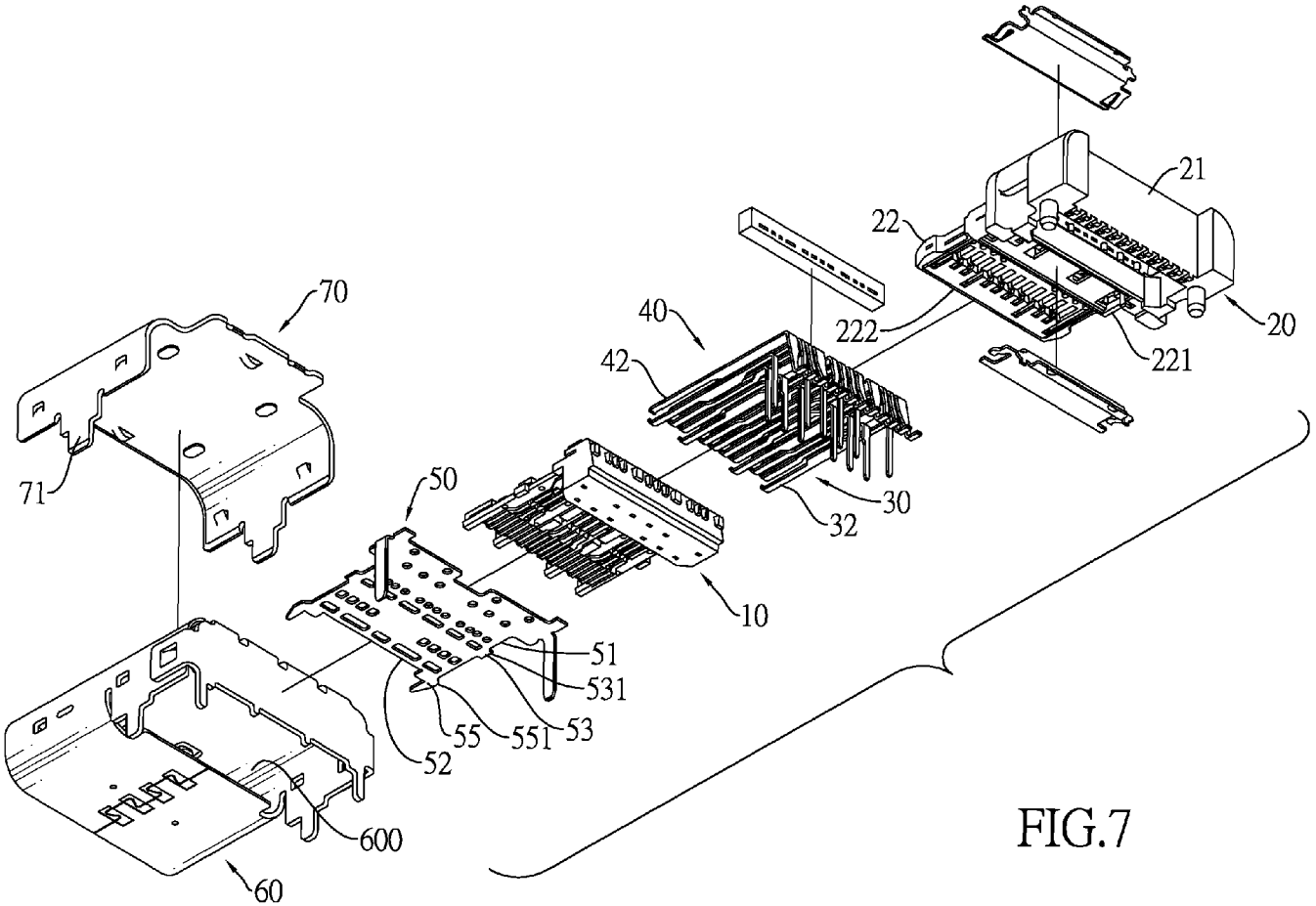
FIG. 7 is another exploded perspective view of the receptacle electrical connector in FIG. 1.
Figure 8:
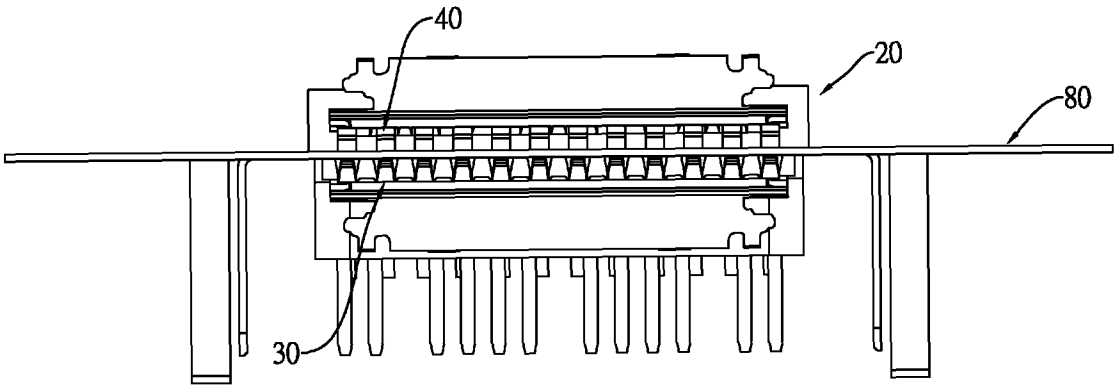
FIG. 8 is a front view of the semi-finished product of the receptacle electrical connector in FIG. 2.

With further reference to FIGS. 7 and 8, the second terminal set is held in the insulated housing, may be mounted on the second insulated housing 20, and has multiple second terminals 40. The second terminals 40 are held in the insulated housing, may be mounted on the second insulated housing 20, and each second terminal 40 has a second electrical contact section 42. The second electrical contact section 42 is formed on a front end of the second terminal 40 and is disposed on a top surface of the tongue portion 22.

The first terminal set and the second terminal set are substantially pointing symmetrical to each other with respect to a centre of symmetry of the tongue portion 22. According to point symmetrical configuration of the first and second terminal sets, when the first and second terminal sets are rotated for 180 degrees with respect to the centre of symmetry, the rotated first and second terminal sets coincide with and are identical to the first and second terminal sets without rotation of 180 degrees. By the point symmetrical configuration of the first and second terminal sets, an electrical plug connector can extend reversely into the reinforced electrical receptacle connector to normally implement high speed signal transmission.

Figure 9:
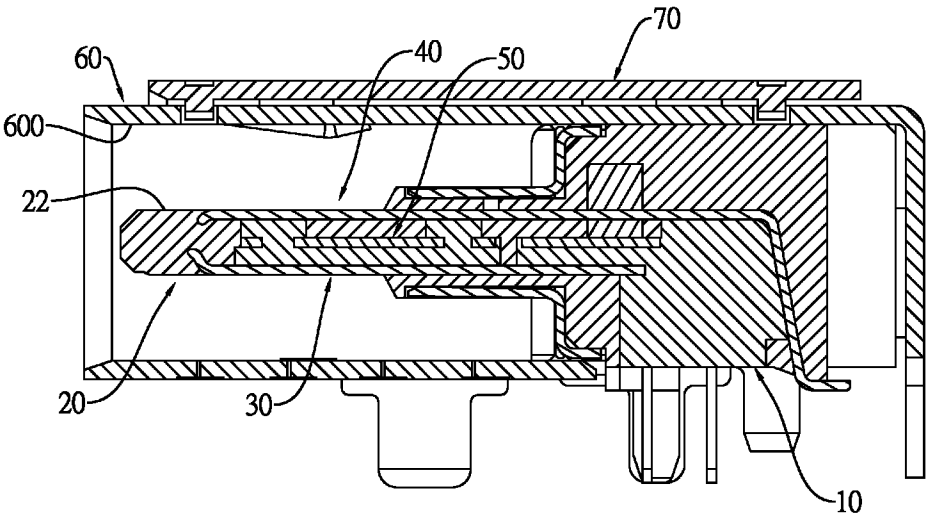
FIG. 9 is a cross sectional side view of the receptacle electrical connector in FIG. 1.

With further reference to FIG. 9, the shielding plate 50 is made of metal, is embedded in the tongue portion 22 of the insulated housing, may be embedded in the first insulated housing 10, is embedded in the tongue portion 22 of the second insulated housing 30 of the insulated housing and is located between the first terminal set and the second terminal set. The shielding plate 50 has two connection portions 53 and two corner reinforcing elements 55.

The connection portions 53 are formed respectively on two opposite sides 51 of the shielding plate 50 and each connection portion 53 has a cutting surface 531 after removing the beltings or linkages. The cutting surface 531 is formed on the connection portion 53, and the two cutting surfaces 531 of the connection portions 53 are exposed out of two opposite side edges 221 of the tongue portion 22. In the first embodiment, the connection portions 53 are formed respectively on and protrude outward from two opposite middle portions of the sides of the shielding plate 50.

The corner reinforcing elements 55 are formed respectively on the sides 51 of the shielding plate 50 adjacent to a front end of the shielding plate 50.

Preferably, the first terminal set and the shielding plate 50 are mounted on the first insulated housing 10 by a first insert-molding process. After the first insert-molding process, the combined first terminal set, the shielding plate 50 and the first insulated housing 10 are further mounted on the second insulated housing 20 by a second insert-molding process.

The metallic shell 60 has a receiving cavity 600 defined through the metallic shell 60 and accommodating the first insulated housing 10 and the second insulated housing 20 of the insulated housing, the first terminal set and the second terminal set.

The outer metallic shell 70 encloses the metallic shell 60 and has two soldering legs formed on and protruding downward respectively from two opposite sides of the outer metallic shell 70 to be soldered on a printed circuit board.

Figure 3:
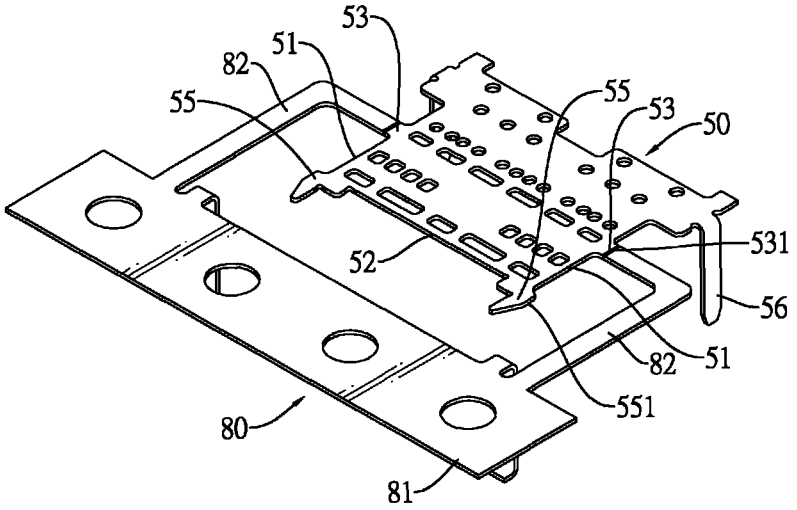
FIG. 3 is a perspective view of the shielding plate connected to the metallic belting by connection beltings as shown in FIG. 2.
Figure 4:
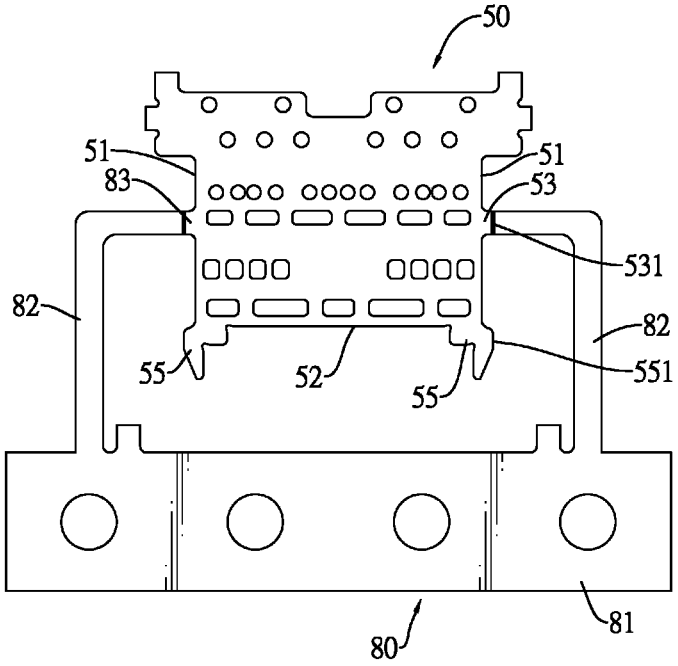
FIG. 4 is a top view of the shielding plate connected to the metallic belting by connection beltings as shown in FIG. 3.
Figure 5:
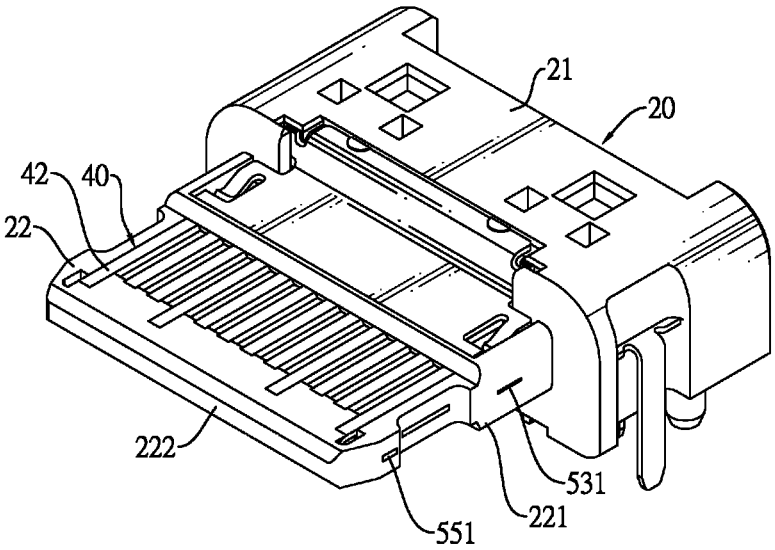
FIG. 5 is a perspective view of the receptacle electrical connector in FIG. 1 omitting a metallic shell and an outer metallic shell.

With further reference to FIGS. 3 and 4, during the manufacturing process of the receptacle electrical connector, the cutting surfaces 531 of the connection portions 53 of the shielding plate 50 are connected integrally to a metallic belting 80. The metallic belting 80 has a connection plate 81 and a pair of connection beltings 82. The connection beltings 82 are formed on and protrude from the connection plate 81 and are integrally connected respectively to the shielding plate 50. According to requirement of a batch manufacturing process, the connection plate 81 may be elongated and has multiple pairs of connection beltings 82 to simultaneously connect to multiple shielding plates 50. The metallic belting 80 may be mounted on a fixture device.

Figure 2:
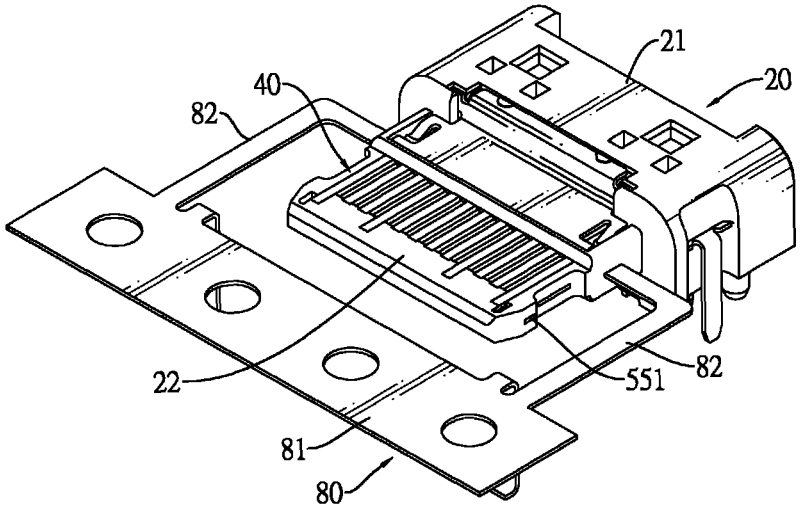
FIG. 2 is a perspective view of a semi-finished product of the receptacle electrical connector in FIG. 1 showing connected metallic belting connected to a shielding plate by connection beltings, wherein the shielding plate is embedded in an insulated housing after two insert-molding processes are performed.

With further reference to FIG. 2, during the batch manufacturing process of the receptacle electrical connector, first of all, multiple first terminal sets are positioned to match multiple shielding plates 50. Then, a first insert-molding process is performed on the multiple first terminal sets and the multiple shielding plates 50 by an insert-molding apparatus to simultaneously form multiple first insulated housings 10. Then, multiple second terminal sets are positioned to match the first insulated housings 10. A second insert-molding process is performed to simultaneously form multiple second insulated housings 20 on the first insulated housings and the second terminal sets. Finally, a cutting tool is used to cut connecting portions between the shielding plates 50 and the metallic beltings 80 such that cutting surface 531 on two opposite sides 51 of each shielding plate 50 are formed.

Figure 10:
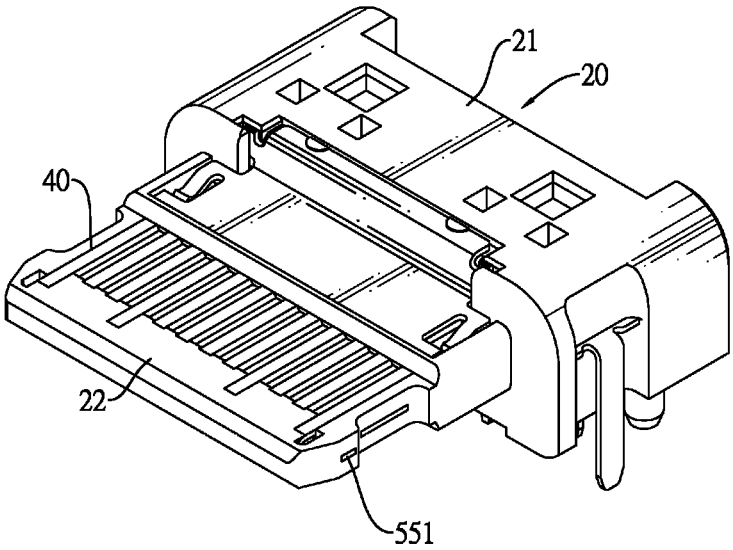
FIG. 10 is a perspective view of a semi-finished product of a second embodiment of a receptacle electrical connector for improving manufacturing process efficiency in accordance with the instant disclosure showing the shielding plate embedded in an insulated housing after two insert-molding processes are performed and the metallic belting and the connection beltings are removed.
Figure 11:
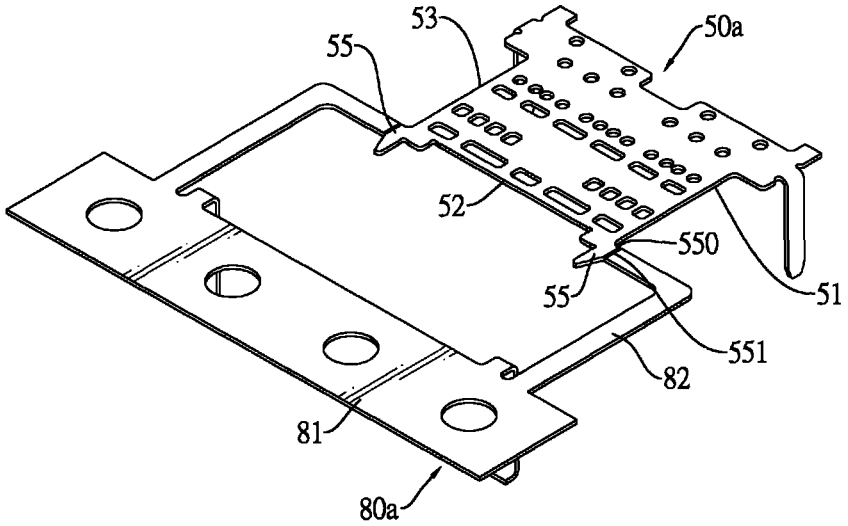
FIG. 11 is a perspective view of the shielding plate and the metallic belting of the receptacle electrical connector in FIG. 10.
Figure 12:
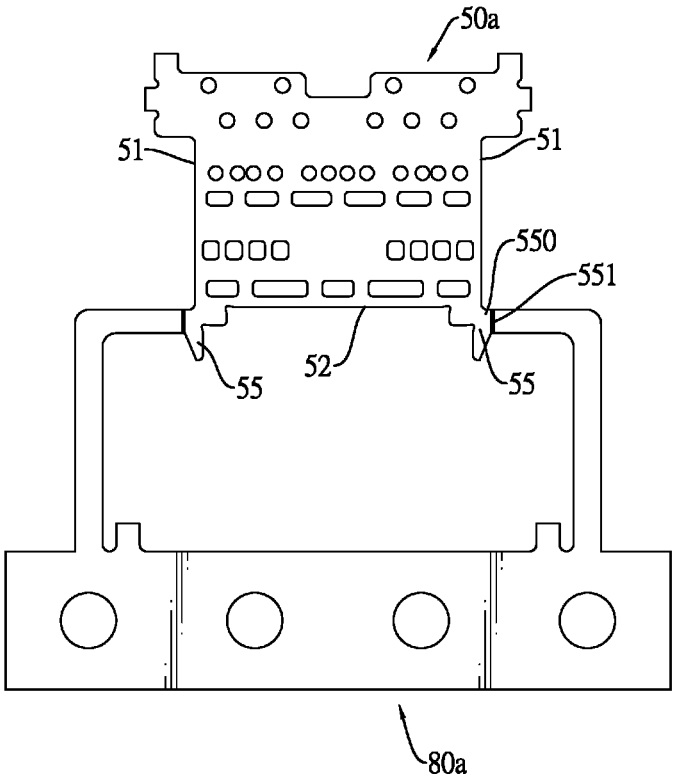
FIG. 12 is a top view of the shielding plate and the metallic belting of the receptacle electrical connector in FIG. 10.

With reference to FIGS. 10 to 12, in a second embodiment of the receptacle electrical connector for improving manufacturing process efficiency in accordance with the instant disclosure, the shielding plate 50*a* has two corner reinforcing elements 55 formed respectively on the opposite sides 51 adjacent to a front end of the shielding plate 50*a*. The connection portions 550 are formed respectively on the corner reinforcing elements 55. The cutting surfaces 551 are formed respectively on the connection portions 550 of the corner reinforcing elements 55 and are exposed out of the side edges 221 of the tongue portion 22 adjacent to a front edge 222 of the tongue portion 22. During the insert-molding processes, the connection beltings 82 of the metallic belting 80*a* are connected to the cutting surfaces 551 of the corner reinforcing elements 55.

The receptacle electrical connectors in accordance with the instant disclosure are made by connecting a single metallic belting 80 integrally to multiple shielding plates 50 to simultaneously insert-mold and form multiple first insulated housing 10 and multiple outer insulative houses 20. Therefore, the insert-molding time is decreased drastically to achieve batch production of the receptacle electrical connector.

Even though numerous characteristics and advantages of the instant disclosure have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A receptacle electrical connector comprising:

an insulated housing having a base portion; and a tongue portion formed on and protruding forward from the base portion;

a first terminal set mounted on the insulated housing and having multiple first terminals mounted on the insulated housing, and each first terminal having a first electrical contact section formed on a front end of the first terminal and mounted on a bottom surface of the tongue portion;

a second terminal set mounted on the insulated housing and having multiple second terminals mounted on the insulated housing, and each second terminal having a second electrical contact section formed on a front end of the second terminal and mounted on a top surface of the tongue portion, wherein the first terminal set and the second terminal set are substantially pointing symmetrical to each other with respect to a centre of symmetry of the tongue portion;

a shielding plate embedded in the tongue portion of the insulated housing, located between the first terminal set and the second terminal set, and having two connection portions protruding respectively from two opposite sides of the shielding plate, and each connection portion having a cutting surface formed on the connection portion, and the two cutting surfaces of the connection portions exposed out of two opposite side edges of the tongue portion, wherein the cutting surfaces are for connecting to a metallic belting; and a metallic shell having a receiving cavity defined through the metallic shell and accommodating the insulated housing, the first terminal set and the second terminal set.

2. The receptacle electrical connector as claimed in claim 1, wherein the insulated housing has a first insulated housing; and a second insulated housing mounted on the first insulated housing, wherein the base portion and the tongue portion are formed on the second insulated housing.

3. The receptacle electrical connector as claimed in claim 2, wherein the shielding plate further has two corner reinforcing elements formed respectively on the sides of the shielding plate adjacent to a front end of the shielding plate; and the connection portions are formed respectively on the corner reinforcing elements; and the cutting surfaces are formed respectively on the connection portions of the corner reinforcing elements and are exposed out of the side edges of the tongue portion adjacent to a front edge of the tongue portion.

4. The receptacle electrical connector as claimed in claim 2, wherein the connection portions are formed respectively on and protrude outward from two opposite middle portions of the sides of the shielding plate.

5. The receptacle electrical connector as claimed in claim 4, wherein the shielding plate further has two corner reinforcing elements formed respectively on the sides of the shielding plate adjacent to a front end of the shielding plate.

6. The receptacle electrical connector as claimed in claim 2, wherein the first terminal set and the shielding plate are mounted on the first insulated housing by a first insert-molding process.

7. The receptacle electrical connector as claimed in claim 6, wherein after the first insert-molding process, the first terminal set, the shielding plate and the first insulated housing are further mounted on the second insulated housing by a second insert-molding process.

8. The receptacle electrical connector as claimed in claim 7 further comprising an outer metallic shell mounted on the metallic shell and having two soldering legs formed on and protruding downward respectively from two opposite sides of the outer metallic shell.

9. A receptacle electrical connector comprising:

an insulated housing having a base portion and a tongue portion formed on and protruding forward from the base portion;

a first terminal set held in the insulated housing and having multiple first terminals held in the insulated housing, and each first terminal having a first electrical contact section formed on a front end of the first terminal and disposed on a bottom surface of the tongue portion;

a second terminal set held in the insulated housing and having multiple second terminals held in the insulated housing, and each second terminal having a second electrical contact section formed on a front end of the second terminal and mounted on a top surface of the tongue portion, wherein the first terminal set and the second terminal set are substantially pointing symmetrical to each other with respect to a centre of symmetry of the tongue portion;

a shielding plate embedded in the tongue portion of the insulated housing, located between the first terminal set and the second terminal set, and having two connection portions protruding respectively from two opposite sides of the shielding plate, and each connection portion having a cutting surface formed on the connection portion, and the two cutting surfaces of the connection portions exposed out of two opposite side edges of the tongue portion, wherein the cutting surfaces are formed by removing connection beltings of a metallic belting; and a metallic shell having a receiving cavity defined through the metallic shell and accommodating the insulated housing, the first terminal set and the second terminal set.

10. The receptacle electrical connector as claimed in claim 9, wherein the connection beltings are formed respectively on and protrude outward from two opposite middle portions of the sides of the shielding plate.

11. The receptacle electrical connector as claimed in claim 9, wherein the shielding plate further has two corner reinforcing elements formed respectively on the sides of the shielding plate adjacent to a front end of the shielding plate.

12. The receptacle electrical connector as claimed in claim 9, wherein the shielding plate further has two corner reinforcing elements formed respectively on the sides of the shielding plate adjacent to a front end of the shielding plate; and the connection beltings are formed respectively on the corner reinforcing elements; and the cutting surfaces are formed respectively on the connection beltings of the corner reinforcing elements and are exposed out of the side edges of the tongue portion adjacent to a front edge of the tongue portion.

13. The receptacle electrical connector as claimed in claim 9 further comprising an outer metallic shell enclosing the metallic shell and having two soldering legs protruding downward respectively from two opposite sides of the outer metallic shell.

* * * * *